US008128442B2

(12) United States Patent
Konakawa et al.

(10) Patent No.: US 8,128,442 B2
(45) Date of Patent: Mar. 6, 2012

(54) OUTBOARD MOTOR INCLUDING DRIVE SHAFT VIBRATION DAMPER

(75) Inventors: Tsugunori Konakawa, Shizuoka (JP); Yusuke Takahashi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 312 days.

(21) Appl. No.: 12/561,345

(22) Filed: Sep. 17, 2009

(65) Prior Publication Data

US 2010/0068952 A1 Mar. 18, 2010

(30) Foreign Application Priority Data

Sep. 18, 2008 (JP) ..... 2008-239218

(51) Int. Cl.
*B63H 1/15* (2006.01)

(52) U.S. Cl. ..... 440/52; 440/83

(58) Field of Classification Search ..... 440/52, 440/83; 464/24, 97

See application file for complete search history.

(56) References Cited

U.S. PATENT DOCUMENTS

| | | | | |
|---|---|---|---|---|
| 4,747,796 | A | 5/1988 | Iwai et al. | |
| 5,697,847 | A * | 12/1997 | Meyer | 464/97 |
| 6,322,407 | B1 | 11/2001 | Onoue | |
| 2008/0022671 | A1 | 1/2008 | Konakawa et al. | |

FOREIGN PATENT DOCUMENTS

| | | | |
|---|---|---|---|
| JP | 60-215495 | A | 10/1985 |
| JP | 2000-280983 | A | 10/2000 |

* cited by examiner

*Primary Examiner* — Edwin Swinehart
(74) *Attorney, Agent, or Firm* — Keating & Bennett, LLP

(57) ABSTRACT

An outboard motor that is capable of reducing a trolling noise includes an engine which has a crank shaft extending in an up-down direction; a drive shaft extending downward from the crank shaft and including a torsion bar spring; a propeller shaft; a propeller provided in the propeller shaft; a forward/backward switching mechanism arranged to connect the drive shaft and the propeller shaft with each other; and a vibration damper which includes a first cylindrical body and a second cylindrical body which are penetrated by the torsion bar spring. The first cylindrical body and the second cylindrical body are coaxial with each other. The first cylindrical body has its upper end portion connected with an upper end portion of the torsion bar spring whereas the second cylindrical body has its lower end portion connected with a lower end portion of the torsion bar spring. A viscous fluid is filled between the first cylindrical body and the second cylindrical body.

3 Claims, 11 Drawing Sheets

OUTBOARD MOTOR INCLUDING DRIVE SHAFT VIBRATION DAMPER

BACKGROUND OF THE INVENTION

1. Field of the Invention

The present invention relates to outboard motors, and more specifically, to an outboard motor including a drive shaft extending downward from an engine and a forward/backward switching mechanism arranged to transmit drive shaft rotation to a propeller shaft.

2. Description of the Related Art

As described in JP-A 2008-31868, for example, conventional outboard motors have a drive shaft extending in an up-down direction for transmitting power from an engine which is located above the water level to a propeller which is located below the water level. The engine is mounted on an upper portion of the outboard motor in such a way that the crank shaft orientation is in the up-down direction.

The crank shaft has a lower end portion connected with an upper end portion of the drive shaft so that they rotate together. The drive shaft has a lower end portion connected, via a forward/backward switching mechanism, with a propeller shaft which extends in a fore-aft direction of the outboard motor. The propeller shaft has a rear end portion provided with a propeller for integral rotation therewith.

The forward/backward switching mechanism includes a driving bevel gear attached to a lower end portion of the drive shaft; a pair of driven bevel gears rotatably supported by the propeller shaft for engagement with the driving bevel gear; and a dog clutch which serves as a switching mechanism to turn on and off power transmission from the driven bevel gears to the propeller shaft. The driven bevel gears sandwich the driving bevel gear from front and back sides of the outboard motor, thereby making engagement with the driving bevel gear.

The dog clutch has a slider which rotates integrally with the propeller shaft between the driven bevel gears, and includes teeth provided at two end portions of the slider and teeth provided in each of the driven bevel gears. The conventional forward/backward switching mechanism can switch between a forward driving state where the teeth on one side of the slider are in engagement with the teeth on one of the driven bevel gears; a rearward driving state where the teeth on the other side of the slider are in engagement with the teeth on the other of the driven bevel gears; and a neutral state where none of the slider teeth are in engagement with any of the teeth of the driven bevel gears.

A problem in the conventional outboard motor described above is a knocking sound which is generated by the forward/backward switching mechanism repeatedly performing switching in a certain periodic cycle when the engine is operating at a constantly low rotation speed such as during trolling. Hereinafter, this knocking sound will be called trolling noise.

The cause of the trolling noise is believed to be mutual hitting of components used in the power transmission mechanism. For this reason, there is a requirement in the conventional outboard motor that the trolling noise should be eliminated so that the components will not be worn by the mutual hitting.

The trolling noise is believed to be caused by mutual resonance of power transmission components which are utilized in the transmission mechanism ranging from the drive shaft to the propeller shaft. Specifically, the trolling noise is believed to be caused in the following sequence: in the dog clutch of the forward/backward switching mechanism, the slider teeth and the driven bevel gear teeth are in engagement with each other during the trolling operation, but become momentarily disengaged by the resonance, and then come back to a strong engagement right after the momentary disengagement.

It should be noted here that as a related art in this field, JP-A SHO 60-215495 discloses a propeller rotation smoothing apparatus for a marine vessel propelling system. In the apparatus, a first transmission section which has a relatively small torsion resistance and a second transmission section which has a relatively large torsion resistance are provided between an engine-side drive shaft and the propeller-side drive shaft. In this arrangement, the engine-side drive shaft and the propeller-side drive shaft are coupled with each other by the first transmission portion for integral rotation with each other. The engine-side drive shaft and the propeller-side drive shaft are designed to perform predetermined relative rotation, and only after that they become coupled by the second transmission portion for integral rotation with each other. However, this apparatus cannot reduce the trolling noise.

SUMMARY OF THE INVENTION

In view of the above, preferred embodiments of the present invention provide an outboard motor that reduces and eliminates trolling noise.

According to a preferred embodiment of the present invention, an outboard motor includes an engine having a crank shaft extending in an up-down direction; a drive shaft extending downward from the crank shaft and having a torsion bar spring; a propeller shaft; a propeller provided in the propeller shaft; a forward/backward switching mechanism arranged to connect the drive shaft and the propeller shaft with each other; and a vibration damper including a first cylindrical body and a second cylindrical body which are penetrated by the torsion bar spring. The first cylindrical body and the second cylindrical body are coaxial with each other and overlapping at least partially with each other. Either one of the first cylindrical body and the second cylindrical body has an upper end portion connected with an upper end portion of the torsion bar spring whereas the other has a lower end portion connected with a lower end portion of the torsion bar spring. A viscous fluid fills a space between the first cylindrical body and the second cylindrical body.

In a preferred embodiment of the present invention, a fluctuating torque of the crank shaft is transmitted to the drive shaft when the drive shaft is turned by the engine. The fluctuation in the torque transmitted to the drive shaft causes a twisting vibration in the drive shaft, i.e., an upper portion which is above the torsion bar spring and a lower portion which is below the torsion bar spring tend to displace in opposite directions. According to a preferred embodiment of the present invention, the twisting vibration in the drive shaft is damped by the vibration damper and therefore, it is possible to reduce the trolling noise which is caused by the twisting vibration of the drive shaft. Therefore, it is possible to prevent wearing of the members which generate the trolling noise. As a result, it is possible to obtain an outboard motor which is not susceptible to abnormal wear of power transmission components.

Preferably, both of the first cylindrical body and the second cylindrical body are extended from the upper end portion to the lower end portion of the torsion bar spring. Therefore, it is possible for the vibration damper, which includes the first cylindrical body and the second cylindrical body, to have the same axial length as that of the torsion bar spring. Hence, it is possible to obtain a sufficient damping force since it is possible to provide a sufficiently long axial length to those portions in the first cylindrical body and the second cylindrical body which are arranged to face each other with the viscous fluid therebetween.

Further preferably, at least one of the first cylindrical body and the second cylindrical body includes an inner cylinder and an outer cylinder. The other of the cylindrical bodies is inserted between the inner cylinder and the outer cylinder. This makes it possible to provide large areas in the opposing circumferential surfaces of the first cylindrical body and the second cylindrical body, and therefore to damp the twisting vibration of the drive shaft efficiently with the vibration damper which includes the first cylindrical body and the second cylindrical body.

Further, preferably, the first cylindrical body has an end portion and the second cylindrical body has an end portion located near the end portion of the first cylindrical body, the outboard motor further includes a stopper provided in both the end portion of the first cylindrical body and the end portion of the second cylindrical body, to limit an axial pivotal movement of one of the cylindrical bodies with respect to the other within a predetermined angle range. Since the stopper can prevent the torsion bar spring of the drive shaft from experiencing excessive twisting, the torsion bar spring may be made of a material which has a relatively small constant of spring. As a result, it is possible to obtain a large amount of displacement of the second cylindrical body with respect to the first cylindrical body with a relatively small load. This makes it possible to damp the above-described twisting vibration more efficiently.

The above-described and other features, elements, steps, characteristics, aspects and advantages of the present invention will become clearer from the following detailed description of preferred embodiments of the present invention with reference to the drawings.

DETAILED DESCRIPTION OF THE PREFERRED EMBODIMENTS

Hereinafter, description will be made for preferred embodiments of the present invention, with reference to the drawings.

Figure 1:
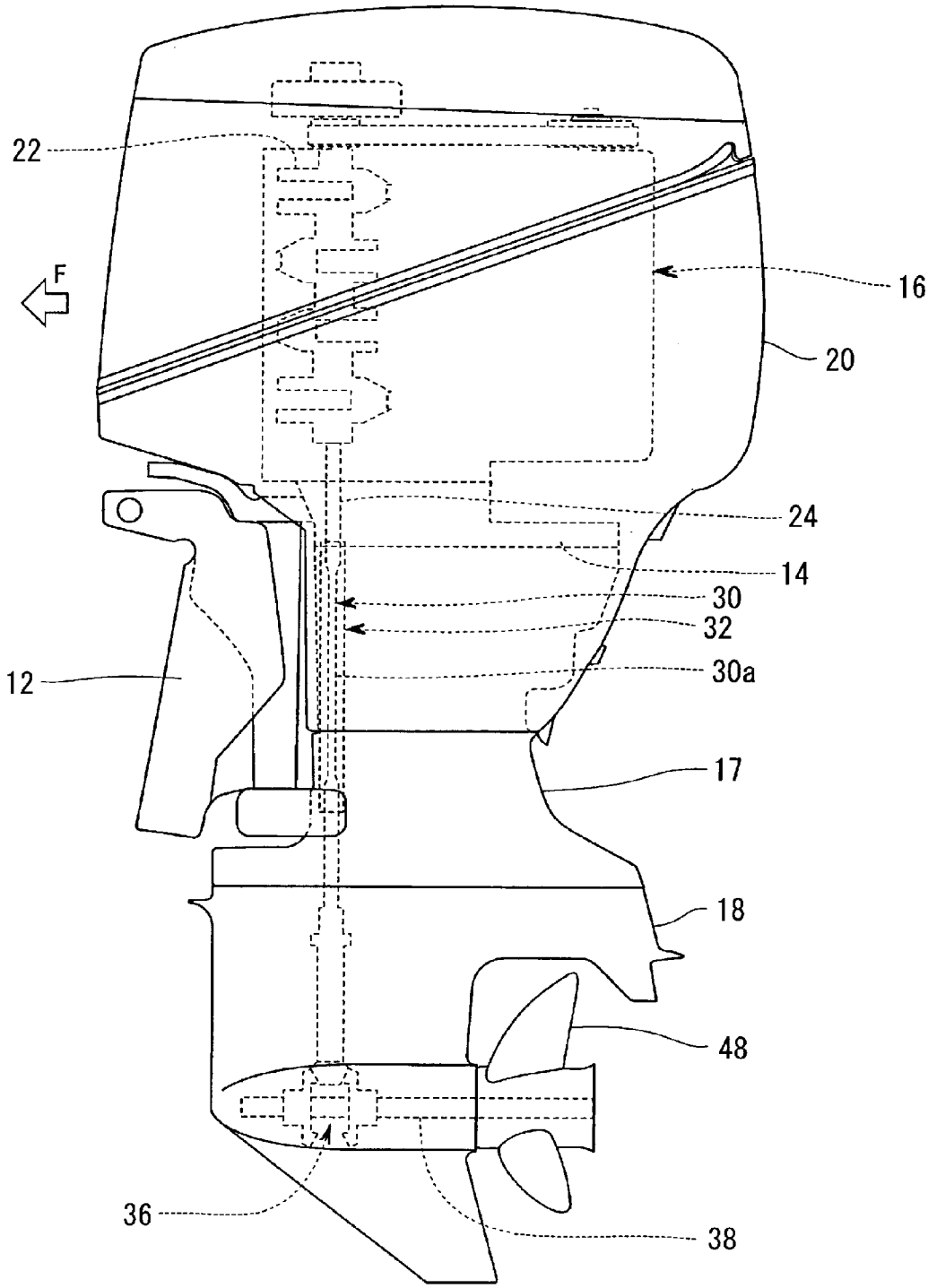
FIG. 1 is a side view of an outboard motor according to a preferred embodiment of the present invention.

Referring to FIG. 1, an outboard motor 10 according to a preferred embodiment of the present invention includes a bracket 12.

The outboard motor 10 is mounted via the bracket 12 steerably and tiltably on a stern board (not illustrated) of a hull. It should be noted here that in this specification, a direction in which a boat including the outboard motor 10 is performing forward travel is simply called a forward direction of the outboard motor 10 whereas the opposite direction is called a rearward direction of the outboard motor 10. In FIG. 1, the forward direction of the outboard motor 10 is indicated by Arrow F.

The outboard motor 10 further includes a guide exhaust 14 connected to an upper end portion of the bracket 12, an engine 16 mounted on the guide exhaust 14, an upper casing 17 attached to a lower end portion of the guide exhaust 14, a lower casing 18 attached to a lower end portion of the upper casing 17, and a cowling 20. The cowling 20 covers generally an upper half portion of the upper casing 17, the guide exhaust 14 and the engine 16.

The engine 16 preferably is a four-cycle, four-cylinder engine, and includes a crank shaft 22. The crank shaft 22 penetrates the engine 16 in the up-down direction.

Figure 2:
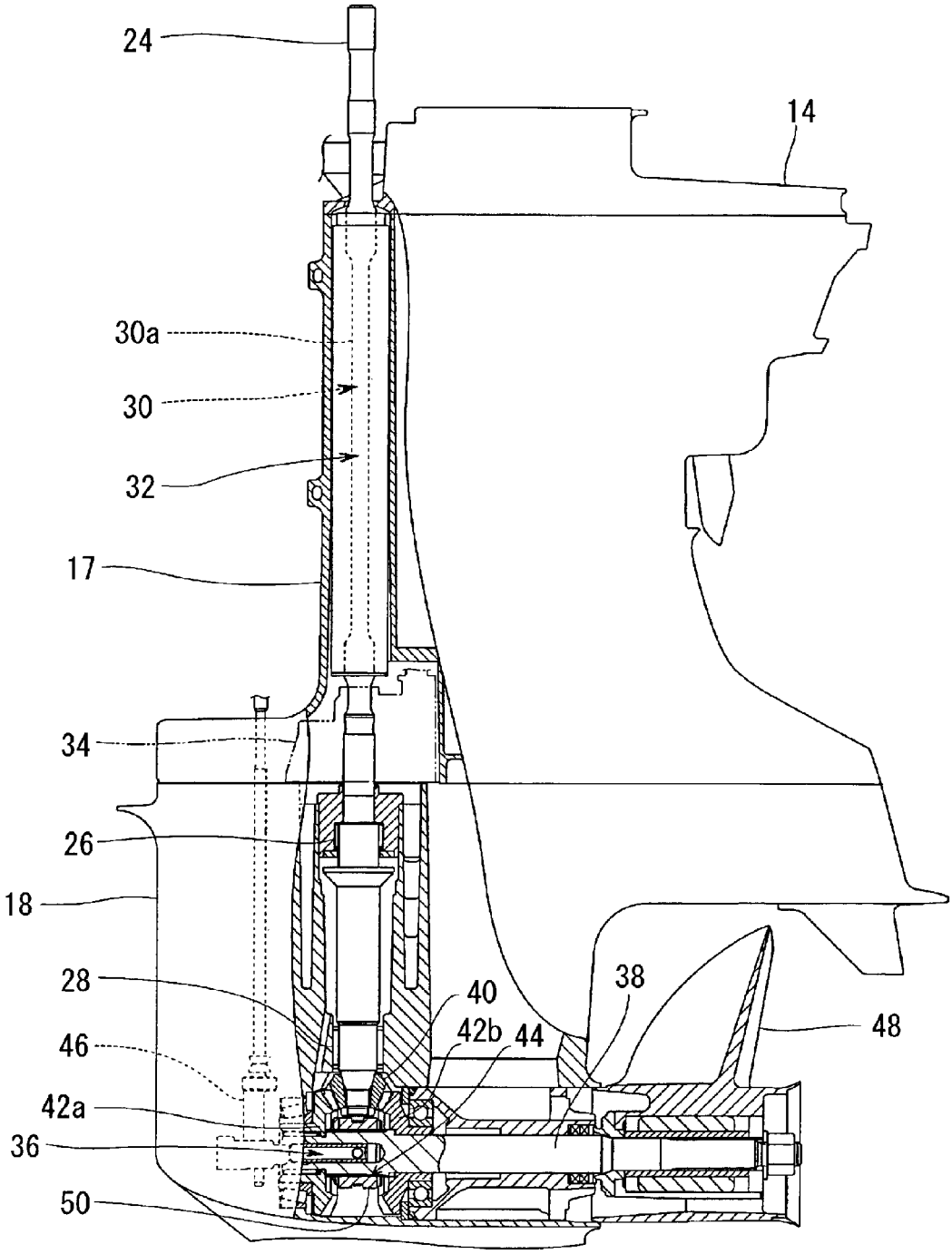
FIG. 2 is an enlarged side view explanatory diagram of a primary portion of the outboard motor.

The crank shaft 22 has a lower end portion connected with an upper end portion of the drive shaft 24. As shown in FIG. 1 and FIG. 2, the drive shaft 24 extends in the up-down direction from a lower end portion of the engine 16 into the lower casing 18. The drive shaft 24 has a lower end portion which is supported rotatably by the lower casing 18 via bearings 26 and 28. A portion of the drive shaft 24 is located inside the upper casing 17, and this portion has an intermediate segment including a torsion bar spring 30 which has a small-diameter portion 30*a*. A vibration damper 32 to be described later surrounds the torsion bar spring 30. A cooling-water pump 34 is preferably provided near and below the vibration damper 32 of the drive shaft 24.

The drive shaft 24 has a lower end portion connected with a propeller shaft 38 via a forward/backward switching mechanism 36.

As shown in FIG. 2, the forward/backward switching mechanism 36 includes a driving bevel gear 40 attached to a lower end portion of the drive shaft 24 for integral rotation therewith; a pair of driven bevel gears 42*a*, 42*b* engaged with the driving bevel gear 40 from the forward side and the rearward side of the outboard motor; a dog clutch 44 arranged to switch between the driven bevel gears 42*a* and 42*b* to thereby select one of the bevel gears to drive the propeller 48 (to be described later); and an operation mechanism 46 to operate the dog clutch 44.

Each of the driven bevel gears 42*a*, 42*b* is supported in the lower casing 18 rotatably by the propeller shaft 38 which extends in the fore-aft direction of the outboard motor 10. The propeller shaft 38 is rotatably supported by the lower casing 18. The propeller shaft 38 has a rear end portion provided with a propeller 48.

The dog clutch 44 includes a slider 50 which is slidably splined to the propeller shaft 38 for axial movement between the driven bevel gears 42*a* and 42*b*, and includes teeth of the slider 50 as well as teeth provided on each of the driven bevel gears 42*a*, 42*b*.

In the forward/backward switching mechanism 36, when the slider 50 is moved by the operation mechanism 46 from a neutral position indicated in FIG. 2, in the forward or the rearward direction of the outboard motor 10, the driven bevel gear 42*a* which is located on the forward side or the driven bevel gear 42*b* which is located on the rearward side comes in engagement with the propeller shaft 38 via the slider 50, causing the propeller 48 to rotate in a normal or a reverse direction.

Now, the vibration damper 32 will be described.

Figure 3:
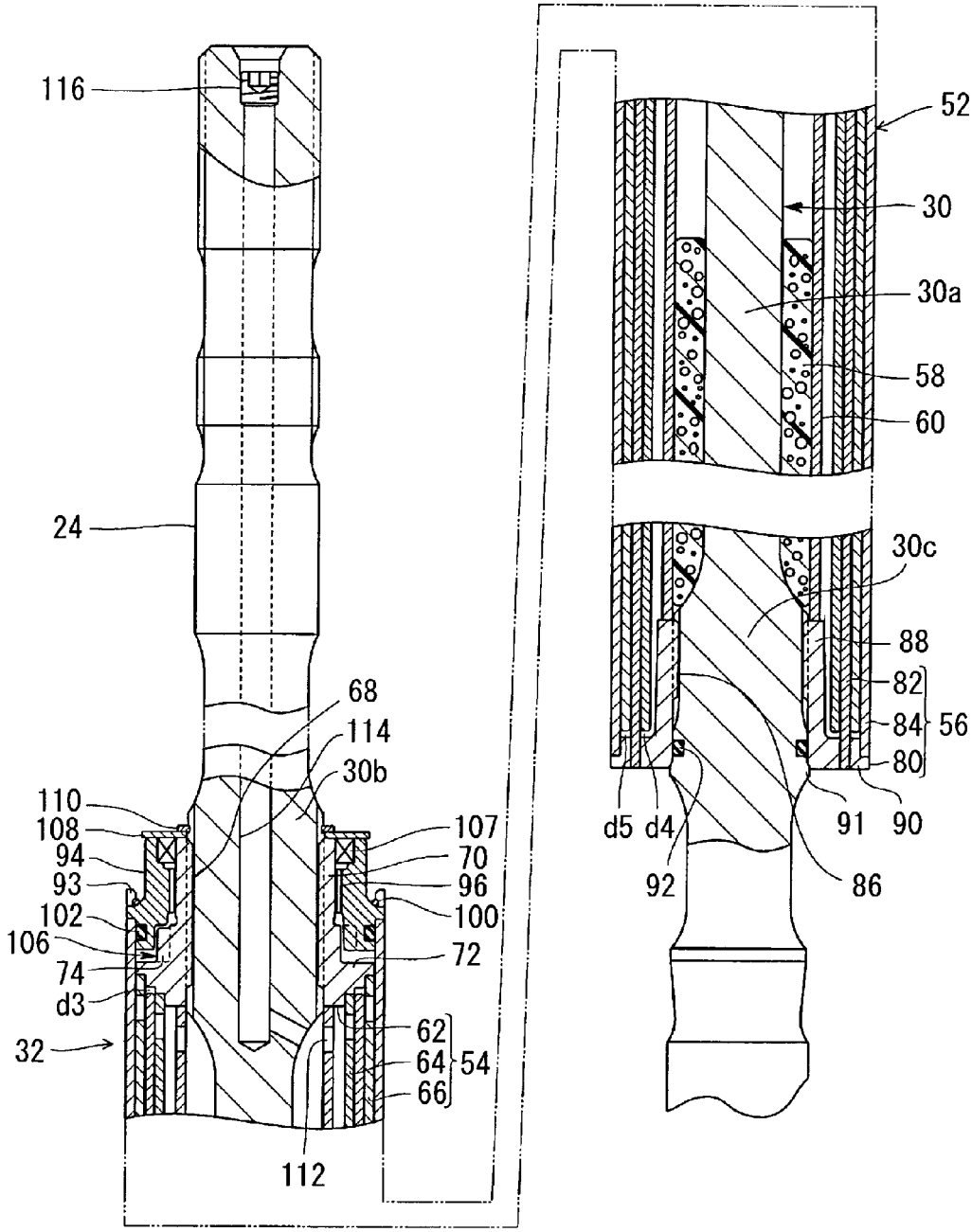
FIG. 3 is a partially unillustrated enlarged sectional view of a vibration damper.

As shown in FIG. 3, the vibration damper 32 includes a multi-walled pipe 52 penetrated by the drive shaft 24, and a viscous fluid VF (see FIG. 11) filled inside the multi-walled pipe 52. The viscous fluid VF is provided by a fluid which does not lose any significant viscosity due to shearing. A non-limiting example of such a fluid is silicone oil.

The multi-walled pipe 52 includes a first cylindrical body 54 attached to an upper end portion 30*b* of the torsion bar spring 30; a second cylindrical body 56 attached to a lower end portion 30*c* of the torsion bar spring 30; a cylindrical stretch member 58 fitted around the torsion bar spring 30; and a cylinder 60 which holds the stretch member 58 around the outer circumference of the torsion bar spring 30.

Figure 4:
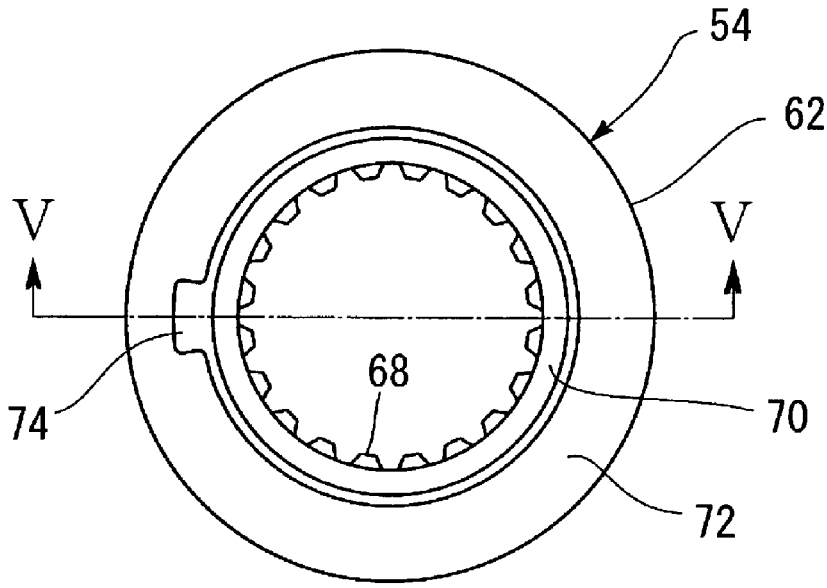
FIG. 4 is a plan view of a first cylindrical body.
Figure 5:
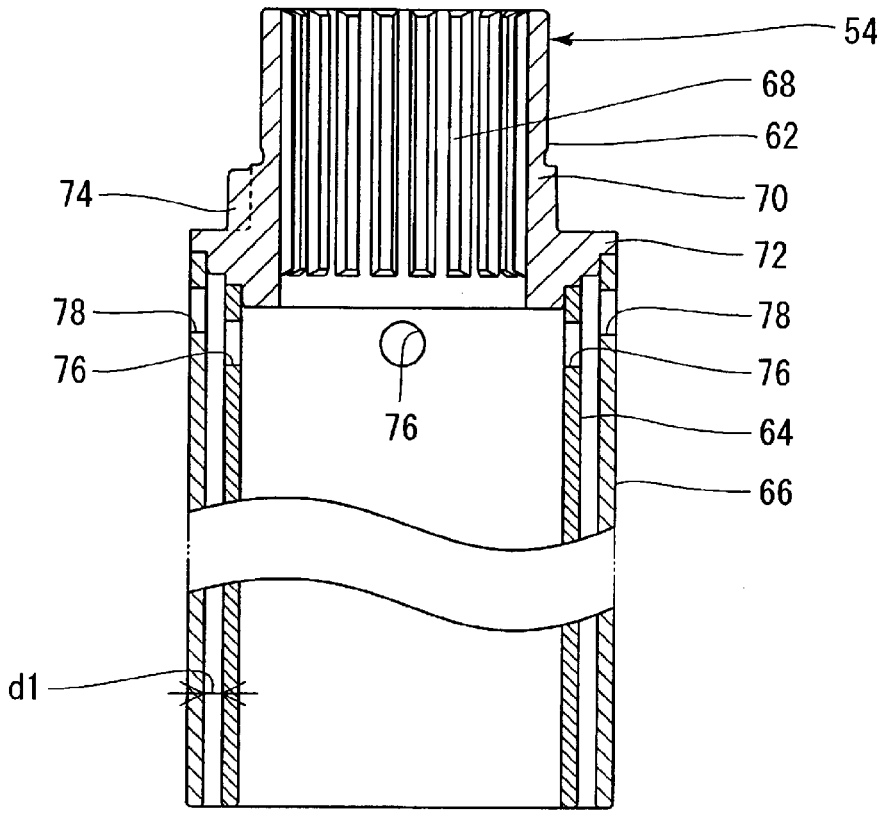
FIG. 5 is a sectional view taken in lines V-V in FIG. 4.

As shown in FIG. 4 and FIG. 5, the first cylindrical body 54 includes a drive-side pipe holder 62, as well as an inner cylinder 64 and an outer cylinder 66 which are extended downward from a lower end portion of the drive-side pipe holder 62.

The drive-side pipe holder 62 includes a cylindrical portion 70 which has a spline 68 for engagement with the drive shaft 24 (the upper end portion 30*b* of the torsion bar spring 30); and a flange 72 which extends in a radially outward direction from a lower end portion of the cylindrical portion 70. The cylindrical portion 70 has an outer circumference including an inner dog 74 which is a component included in a stopper 106 to be described later. The inner dog 74 protrudes radially outward from the outer circumference of the cylindrical portion 70. The drive-side pipe holder 62 is attached to the upper end portion 30*b* of the torsion bar spring 30 for integral rotation therewith, using the spline 68.

Each of the inner cylinder 64 and the outer cylinder 66 preferably includes a pipe which has a circular cross-section, and is welded to the flange 72 for a coaxial positioning with respect to the drive shaft 24. The outer cylinder 66 is welded to an outer circumferential end portion of the flange 72. The inner cylinder 64 is positioned inside the outer cylinder 66, and is welded to the flange 72. In this state, the inner cylinder 64 is coaxial with the outer cylinder 66, and is spaced from an inner circumferential surface of the outer cylinder 66 by a predetermined gap d1 (see FIG. 5).

As shown in FIG. 3, each of the inner cylinder 64 and the outer cylinder 66 has a specifically designed length so that the lower end portion of the inner cylinder 64 and the lower end portion of the outer cylinder 66 reach the lower end portion 30*c* of the torsion bar spring 30 in a state in which the drive-side pipe holder 62 is assembled to the drive shaft 24.

As shown in FIG. 5, an upper end portion of the inner cylinder 64 and an upper end portion of the outer cylinder 66 include a plurality of through-holes 76, 78 respectively.

Figure 6:
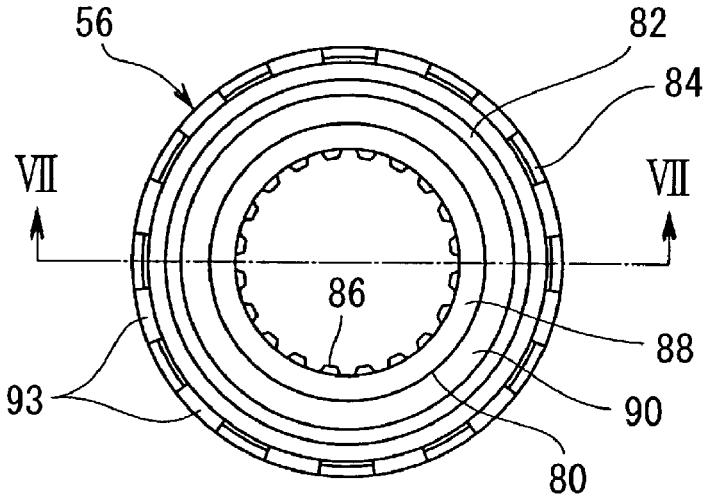
FIG. 6 is a plan view of a second cylindrical body.
Figure 7:
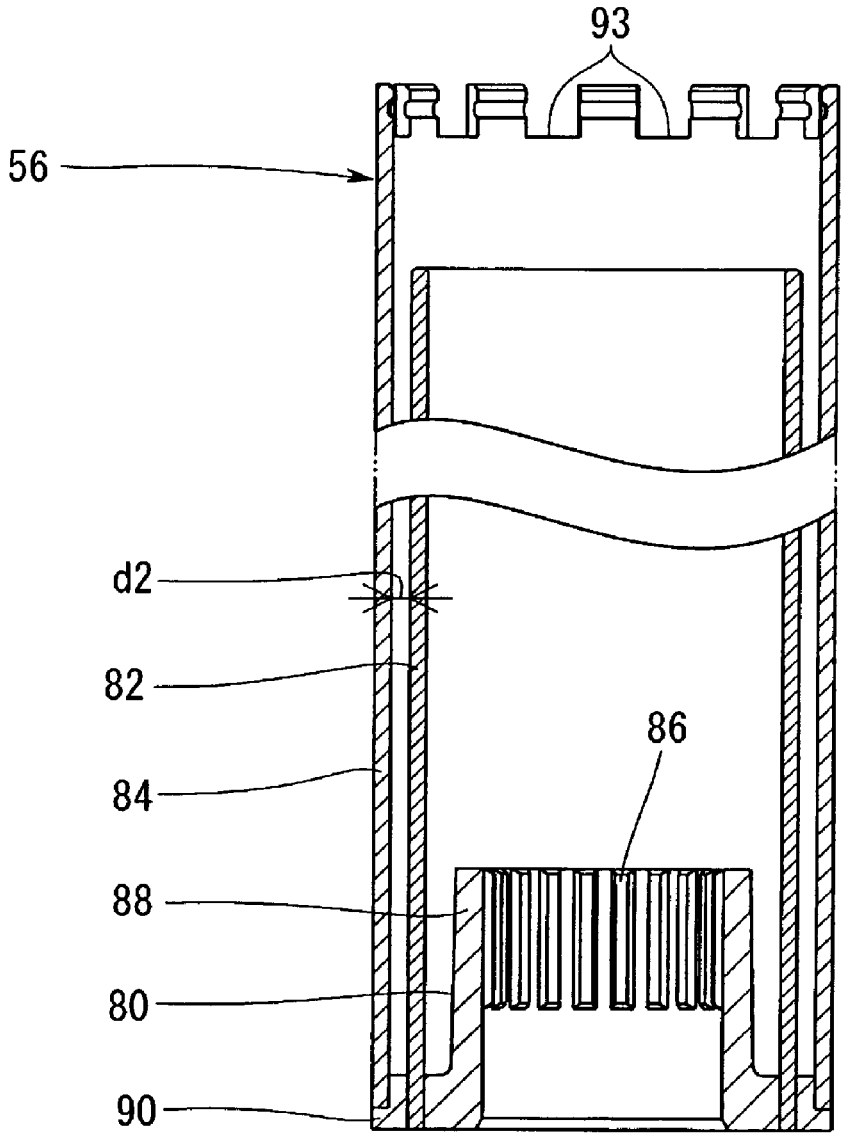
FIG. 7 is a sectional view taken in lines VII-VII in FIG. 6.

As shown in FIG. 6 and FIG. 7, the second cylindrical body 56 includes a driven-side pipe holder 80 as well as an inner cylinder 82 and an outer cylinder 84 extended upward from a lower end portion of the driven-side pipe holder 80.

The driven-side pipe holder 80 includes a cylindrical portion 88 which has a spline 86 for engagement with the drive shaft 24 (the lower end portion 30*c* of the torsion bar spring 30), and a flange 90 which extends radially outward from a lower end portion of the cylindrical portion 88. The driven-side pipe holder 80 is attached to the lower end portion 30*c* of the torsion bar spring 30 for integral rotation therewith, using the spline 86. In this state, as shown in FIG. 3, the driven-side pipe holder 80 which is assembled to the drive shaft 24 is in contact, from above, with a ridge 91 which is arranged around an outer circumference of the drive shaft 24. An O-ring 92 is provided between a lower end portion of the driven-side pipe holder 80 and the drive shaft 24 in order to prevent the viscous fluid VF from leaking. As shown in FIG. 3, the first cylindrical body 54 is connected with the driven-side pipe holder 80 of the second cylindrical body 56 via the cylinder 60 for holding the stretch member 58, and is limited by the driven-side pipe holder 80 in its downward movement.

Each of the inner cylinder 82 and the outer cylinder 84 in the second cylindrical body 56 includes a pipe which has a circular cross-section, and is welded to the flange 80 for a coaxial positioning with respect to the drive shaft 24. The outer cylinder 84 is welded to an outer circumferential end portion of the flange 80. The inner cylinder 82 is positioned inside the outer cylinder 84, and is welded to the flange 80. In this state, the inner cylinder 82 is coaxial with the outer cylinder 84, and is spaced from an inner circumferential surface of the outer cylinder 84 by a predetermined gap d2 (see FIG. 7). The inner cylinder 82 has its outer diameter and inner diameter designed so that the inner cylinder 82 can be loosely inserted from below, into the space (gap d1) between the inner cylinder 64 and the outer cylinder 66 of the first cylindrical body 54. In other words, the thickness of the inner cylinder 82 in the second cylindrical body 56 is slightly smaller than the gap d1.

On the other hand, the outer cylinder 66 of the first cylindrical body 54 has its outer diameter and inner diameter designed so that the outer cylinder 66 can be loosely inserted from above, into the space (gap d2) between the inner cylinder 82 and the outer cylinder 84 of the second cylindrical body 56. In other words, the thickness of the outer cylinder 66 in the first cylindrical body 54 is slightly smaller than the gap d2.

As shown in FIG. 3, each of the inner cylinder 82 and the outer cylinder 84 of the second cylindrical body 56 has a specifically designed length so that the upper end portion of the inner cylinder 82 and the upper end portion of the outer cylinder 84 are positioned near the drive-side pipe holder 62 in a state where the driven-side pipe holder 80 is assembled to the drive shaft 24.

Figure 11:
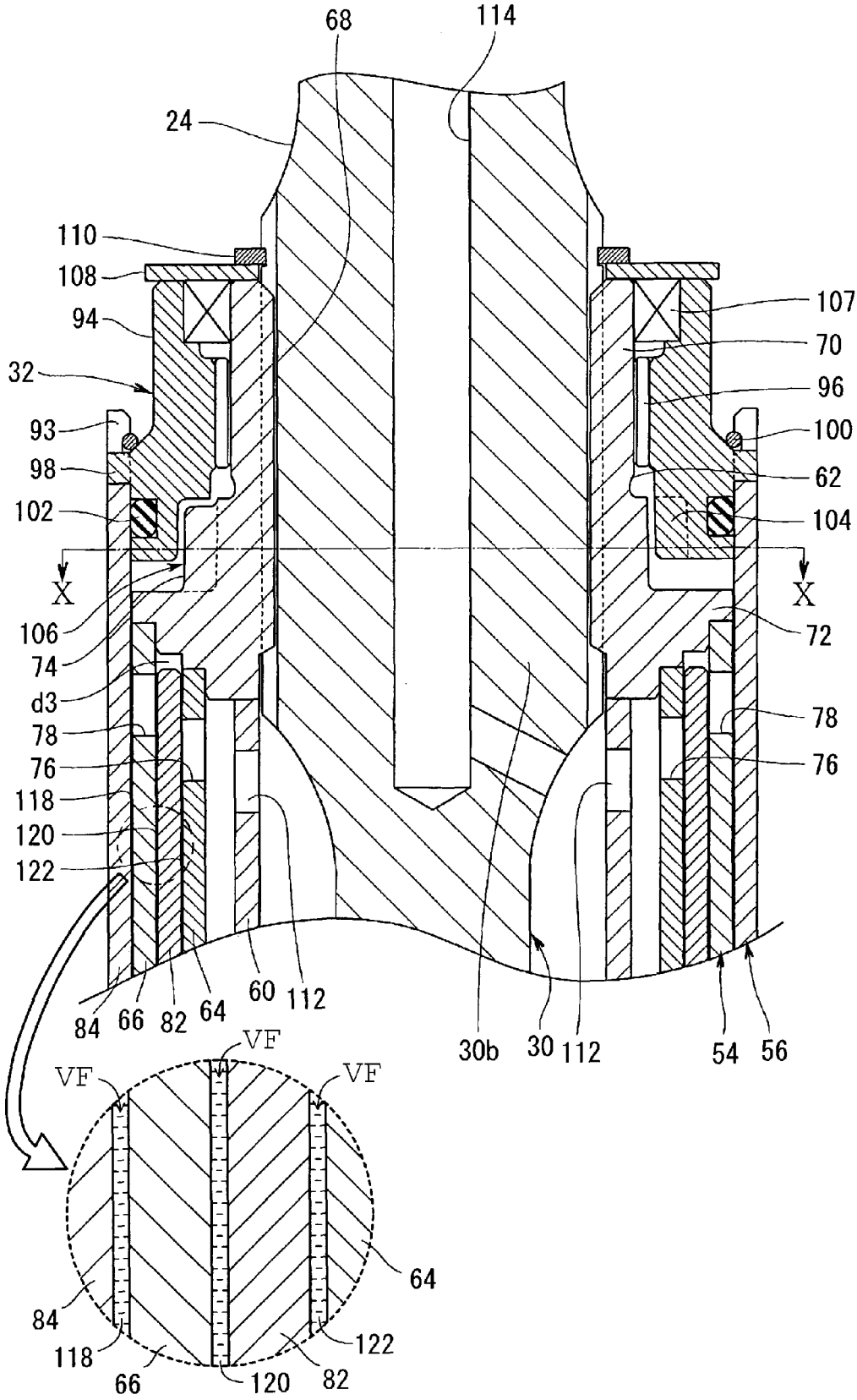
FIG. 11 is an enlarged vertical-sectional view of an upper end portion of the vibration damper.

More specifically, the length of the inner cylinder 82 is designed to provide a gap d3 (see FIG. 3 and FIG. 11) between the upper end portion of the inner cylinder 82 and the lower surface of the drive-side pipe holder 62 so that the fluid can pass through. As shown in FIG. 3 and FIG. 11, the length of the outer cylinder 84 is designed so that the upper end portion of the outer cylinder 84 is above the flange 72, and overlapping with the cylindrical portion 70 of the drive-side pipe holder 62 in a side view. Also, as shown in FIG. 6 and FIG. 7, the outer cylinder 84 has an upper end edge that includes a plurality of cutouts 93 at a predetermined interval around the entire circumference of the outer cylinder 84.

Further, the second cylindrical body 56 includes a damper end 94. The damper end 94 is provided between an upper end portion of the outer cylinder 84 and the cylindrical portion 70 of the drive-side pipe holder 62 in order to connect an upper end portion of the first cylindrical body 54 with an upper end portion of the second cylindrical body 56.

Figure 8:
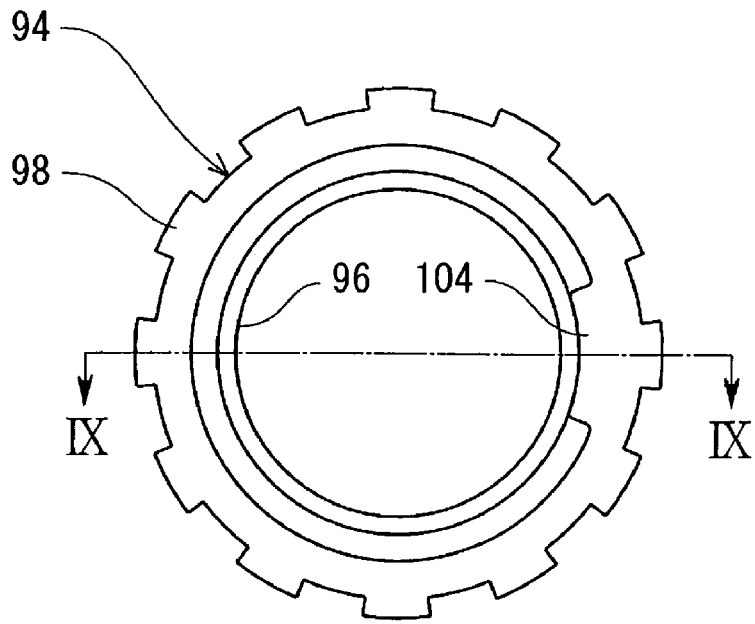
FIG. 8 is a bottom view of a damper end.
Figure 9:
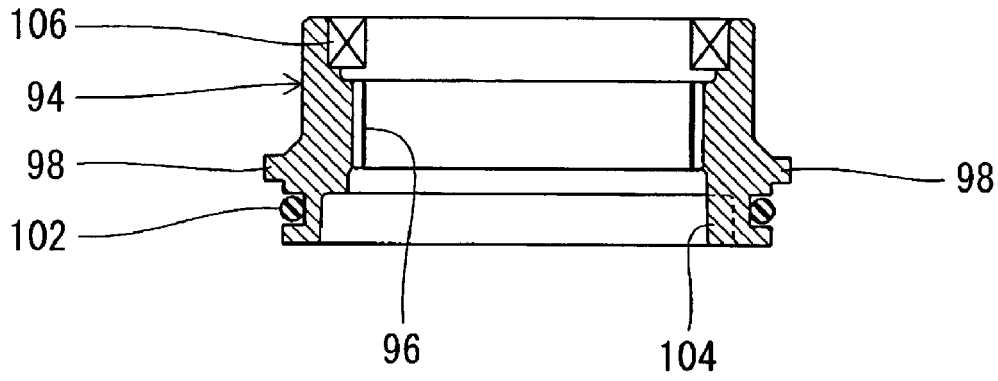
FIG. 9 is a sectional view taken in lines IX-IX in FIG. 8.

The damper end 94 preferably is substantially cylindrical, is inserted around the cylindrical portion 70, and is supported rotatably thereby via a bearing 96. As shown in FIG. 8 and FIG. 9, the damper end 94 has an outer circumference that includes a plurality of projections 98 at a predetermined interval around the entire circumference of the damper end 94. These projections 98 fit into the cutouts 93 which are arranged on the outer cylinder 84 of the second cylindrical body 56.

Specifically, due to the fitting engagement between the projections 98 and the cutouts 93, the damper end 94 and the outer cylinder 84 of the second cylindrical body 56 are connected with each other so that one does not rotate relative to the other (so that they rotate integrally with each other). Also, as shown in FIG. 3 and FIG. 11, a C-ring 100 is arranged around the inside of the upper end portion of the outer cylinder 84 to limit a travel of the damper end 94 so that the damper end 94 does not come off the outer cylinder 84.

An O-ring 102 is provided between the damper end 94 and the outer cylinder 84 in order to prevent leakage of the viscous fluid VF.

The damper end 94 has an inner circumferential portion provided with an outer dog 104 which works with the inner dog 74 of the drive-side pipe holder 62. The outer dog 104 protrudes radially inward from the inner circumferential surface of the damper end 94.

Figure 10:
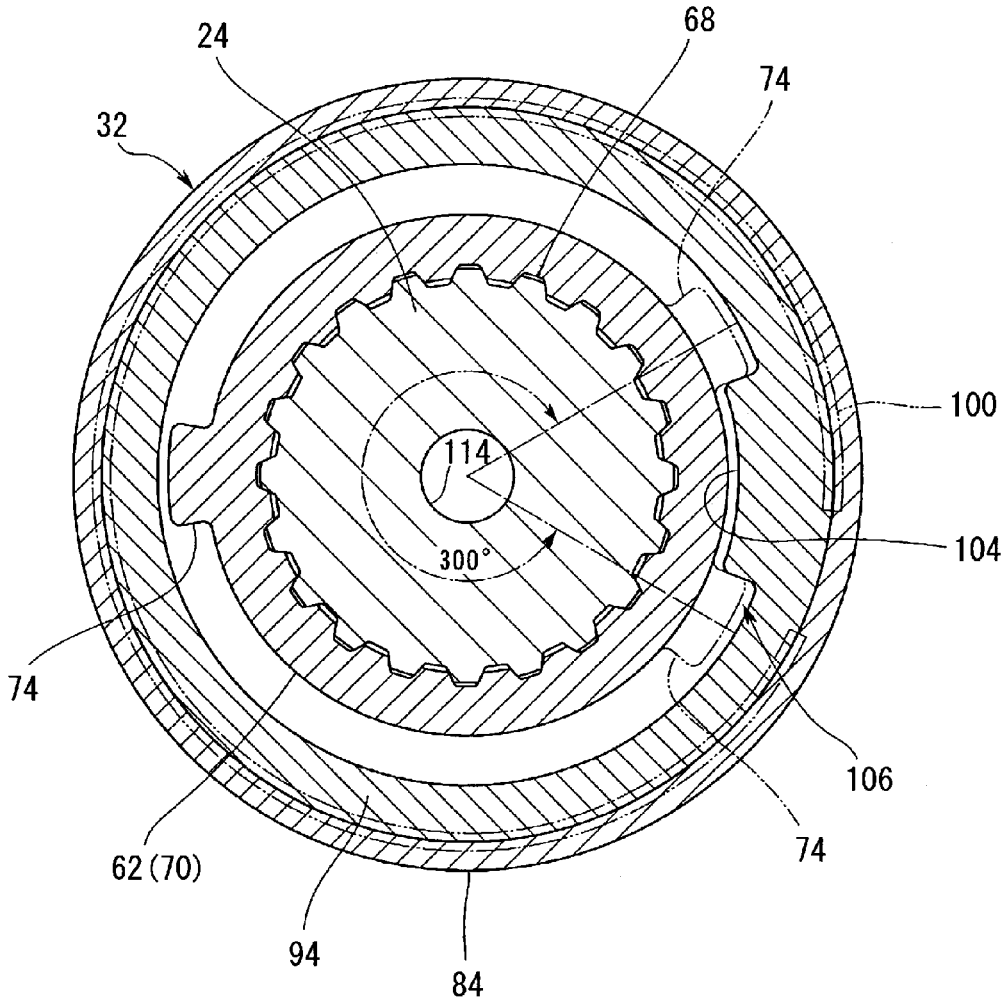
FIG. 10 is a cross-sectional view of a connecting portion between the first cylindrical body and the second cylindrical body.

The stopper 106 limits axial pivotal movement of the second cylindrical body 56 with respect to the first cylindrical body 54 within a predetermined angle range. In the present preferred embodiment, the stopper 106 includes the inner dog 74 and the outer dog 104, and functions as an over-twist stopper. As shown in FIG. 10 and FIG. 11, the inner dog 74 and the outer dog 104 are provided at the same axial position on the drive shaft 24 so that they can come into contact with each other in the pivotal movement. As shown in FIG. 10, the stopper 106 allows the second cylindrical body 56 to make a maximum pivotal movement by approximately 300 degrees with respect to the first cylindrical body 54, for example.

As shown in FIG. 3 and FIG. 11, a sealing member 107 is provided between an upper end portion of the damper end 94 and the cylindrical portion 70 of the drive-side pipe holder 62. Also, a washer 108 and a circlip 110 for engagement around the drive shaft 24 are provided on the damper end 94 and the cylindrical portion 70 in order to hold the vibration damper 32 at a predetermined position on the drive shaft 24.

The stretch member 58 preferably has a cylindrical shape and is preferably formed of a highly stretchable material such as sponge, so that it can be stretched/compressed when the viscous fluid VF loaded inside the vibration damper 32 changes its volume due to thermal expansion for example. As shown in FIG. 3, the stretch member 58 is provided between the cylinder 60 which is penetrated by the drive shaft 24 and the torsion bar spring 30. The cylinder 60 is coaxial with the torsion bar spring 30, and is sandwiched by the drive-side pipe holder 62 of the first cylindrical body 54 and the driven-side pipe holder 80 of the second cylindrical body 56, from mutually opposing sides of the axis. The cylinder 60 has an upper end portion including a plurality of communication holes 112 (see FIG. 3 and FIG. 11), and thus provides communication between inside and outside of the cylinder 60.

As shown in FIG. 3, a fluid hole 114 extends in the up-down direction from an upper end of the drive shaft 24 to the upper end portion 30*b* of the torsion bar spring 30, for charging the damper with the viscous fluid VF. The fluid hole 114 has a lower end portion opening near the communication hole 112 in the cylinder 60. After the damper has been filled with the viscous fluid VF, the upper end portion of the fluid hole 114 is closed as shown in FIG. 3, with a plug member 116 defined by a screw, for example.

Now, description will cover an assembling procedure of the vibration damper 32.

First, the O-ring 92 is assembled to the lower end portion 30*c* of the torsion bar spring 30. In this state, the drive shaft 24 is inserted into the second cylindrical body 56 from below. The drive shaft 24 is inserted until the ridge 91 of the lower end portion 30*c* of the torsion bar spring 30 makes contact with the driven-side pipe holder 80 of the second cylindrical body 56. Thereafter, the stretch member 58 is fitted around the torsion bar spring 30 inside the second cylindrical body 56 and then, the viscous fluid VF is poured from the fluid hole 114 of the drive shaft 24 into the second cylindrical body 56.

Next, the cylinder 60 for holding the stretch member 58 is inserted into the second cylindrical body 56 from above. Further, the inner cylinder 64 and the outer cylinder 66 of the first cylindrical body 54 are inserted into the second cylindrical body 56 from above. In this process, the insertion of the first cylindrical body 54 is done in such a way that the inner cylinder 82 of the second cylindrical body 56 comes between the inner cylinder 64 and the outer cylinder 66 of the first cylindrical body 54.

Thereafter, an assembly of the damper end 94, the bearing 96 and the O-ring 102 is inserted between the outer cylinder 84 of the second cylindrical body 56 and the cylindrical portion 70 of the drive-side pipe holder 62. In this process, the projections 98 in the damper end 94 are fitted into the cutouts 93 in the outer cylinder 84. Also, when assembling the damper end 94, the outer dog 104 is set to an appropriate rotational position so that the outer dog 104 is on the radially opposite side (180 degrees away from the circumferential direction) with respect to the inner dog 74. Then, the C-ring 100 is attached, and the sealing member 107, the washer 108 and the circlip 110 are attached. Further, the plug member 116 is threaded into the upper end portion of the drive shaft 24, and this completes the assembly of the vibration damper 32.

According to the outboard motor 10 described above, rotation of the crank shaft 22 in the engine 16 is transmitted through the drive shaft 24, the forward/backward switching mechanism 36 and the propeller shaft 38, to the propeller 48. In this process, the torsion bar spring 30 provided in the drive shaft 24 is elastically deformed and therefore twisted in accordance with the amount of torque transmitted by the drive shaft 24. When the engine 16 is performing at its maximum output, the twist of the torsion bar spring 30 allows mutual engagement of the inner dog 74 and the outer dog 104 in the stopper 106.

On the other hand, as shown in FIG. 11, in the vibration damper 32 assembled as described earlier, a first fluid layer 118 is arranged between the outer cylinder 66 of the first cylindrical body 54 and the outer cylinder 84 of the second cylindrical body 56; a second fluid layer 120 is arranged between the outer cylinder 66 of the first cylindrical body 54 and the inner cylinder 82 of the second cylindrical body 56; and a third fluid layer 122 is arranged between the inner cylinder 82 the second cylindrical body 56 and the inner cylinder 64 of the first cylindrical body 54. The first fluid layer 118 through the third fluid layer 122 are filled with the viscous fluid VF loaded in the damper.

The viscous fluid VF fills the space inside the vibration damper 32 since the fluid is distributed throughout the entire vibration damper 32 via the communication holes 76, 78 provided in the inner cylinder 64 and the outer cylinder 66 of the first cylindrical body 54; the gap d3 (see FIG. 11) provided between the inner cylinder 82 of the second cylindrical body 56 and the drive-side pipe holder 62 of the first cylindrical body 54; the gaps d4, d5 (see FIG. 3) provided between the inner cylinder 64 of the first cylindrical body 54 and the driven-side pipe holder 80 of the second cylindrical body 56, and between the outer cylinder 66 of the first cylindrical body 54 and the driven-side pipe holder 80 of the second cylindrical body 56; the communication holes 112 provided on the upper end portion of the cylinder 60; and so on.

Now, when the first cylindrical body 54 and the second cylindrical body 56 are displaced in their rotating directions relative to each other in the vibration damper 32, a damping force is developed in the first fluid layer 118 through the third fluid layer 122 due to a shear resistance from the viscous fluid VF.

When the drive shaft 24 is turned by the engine 16, a fluctuating torque of the crank shaft 22 is transmitted to the drive shaft 24. The reason why the torque is fluctuating is that the engine 16 in the present preferred embodiment undergoes an exploding step four times while the crank shaft 22 rotates twice. Thus, the upper end portion of the drive shaft 24 receives a fluctuating torque from the crank shaft 22.

On the other hand, while the boat is moving, the propeller 48 is under inertia and therefore, the propeller shaft 38 and the forward/backward switching mechanism 36 tend to rotate together with the propeller 48 even after the driving power from the engine 16 is stopped. In other words, the lower end portion of the drive shaft 24 is subject to an inertial force for continual rotation together with the propeller 48.

As has been described, circumstances relevant to rotation are different within the drive shaft 24, i.e., between an upper portion which is above the torsion bar spring 30 and a lower portion which is below the torsion bar spring 30, and for this reason, there can be a case where the drive shaft 24 is subject to a twisting vibration in which the upper portion and the lower portion are subjected to displacing forces acting in opposite directions. In the conventional outboard motor, it is believed that the drive shaft which is vibrating as described above and the dog clutch of the forward/backward switching mechanism hit against each other due to resonance, thereby generating the trolling noise.

According to the outboard motor 10, when the drive shaft 24 is subjected to the twisting vibration, the second cylindrical body 56 rotates with respect to the first cylindrical body 54 of the vibration damper 32, thereby generating a damping force as described earlier. In other words, the outboard motor 10 can damp the twisting vibration with the vibration damper 32. Therefore, it is possible to reduce and prevent the trolling noise which is caused by the twisting vibration of the drive shaft 24 and as a result, it is possible to prevent wearing of those members which generate the trolling noise.

According to the outboard motor 10, both of the first cylindrical body 54 and the second cylindrical body 56 are designed to have a length to extend from the upper end portion 30*b* of the torsion bar spring 30 to the lower end portion 30*c* thereof. Therefore, it is possible for the vibration damper 32, which includes the first cylindrical body 54 and the second cylindrical body 56, to have the same axial length as that of the torsion bar spring 30. Hence, a sufficient damping force is obtained according to the outboard motor 10 since it is possible to provide a sufficiently long axial length to those portions in the first cylindrical body 54 and the second cylindrical body 56 which are arranged to face to each other via the viscous fluid VF.

The first cylindrical body 54 and the second cylindrical body 56 are provided with the inner cylinders 64, 82, respectively, and the outer cylinders 66, 84, respectively. The inner cylinder 82 of the second cylindrical body 56 is inserted between the inner cylinder 64 and the outer cylinder 66 of the first cylindrical body 54 whereas the outer cylinder 66 of the first cylindrical body 54 is inserted between the inner cylinder 82 and the outer cylinder 84 of the second cylindrical body 56. This makes it possible to provide large areas in the opposing circumferential surfaces of the first cylindrical body 54 and the second cylindrical body 56, and therefore to damp the twisting vibration of the drive shaft 24 efficiently with the vibration damper 32 which includes the first cylindrical body 54 and the second cylindrical body 56.

The stopper 106 is provided in an upper end portion of the first cylindrical body 54 as well as near the upper end portion, i.e., in an upper end portion of the second cylindrical body 56, in order to limit the range of axial rotation of one cylindrical body with respect to the other within a predetermined angle range. Since the stopper 106 can prevent the torsion bar spring 30 of the drive shaft 24 from excessive twisting, the torsion bar spring 30 may be made of a material which has a relatively small spring constant. As a result, it is possible, with a relatively small load, to obtain a large amount of displacement of the second cylindrical body 56 with respect to the first cylindrical body 54. This makes it possible to damp the above-described twisting vibration more efficiently.

In the preferred embodiment described above, the torsion bar spring 30 is preferably covered by the vibration damper 32 which includes the multi-walled pipe 52. This arrangement provides reinforcement by the vibration damper 32 to the torsion bar spring 30 which has a relatively small diameter and a lower level of rigidity in bending directions. Therefore, twisting vibrations are less likely to develop in the drive shaft 24, making it possible to prevent abnormal sound caused by the vibrations.

In the preferred embodiment described above, the first cylindrical body 54 preferably has its upper end portion attached to the upper end portion 30*b* of the torsion bar spring 30 whereas the second cylindrical body 56 preferably has its lower end portion attached to the lower end portion 30*c* of the torsion bar spring 30. However, the present invention is not limited to this. For example, the first cylindrical body 54 and the second cylindrical body 56 may be arranged upside down from the state in the described preferred embodiment when they are attached to the torsion bar spring 30. In this case, a lower end portion of the first cylindrical body 54 is attached to the lower end portion 30*c* of the torsion bar spring 30 whereas an upper end portion of the second cylindrical body 56 is attached to the upper end portion 30*b* of the torsion bar spring 30.

Also, the numbers of cylinders (inner cylinders, outer cylinders and so on) included in the first cylindrical body 54 as well as in the second cylindrical body 56 are not limited to those numbers used in the preferred embodiment described above, and may be varied as appropriate. For example, there may be an arrangement where either one of the first cylindrical body 54 and the second cylindrical body 56 has an inner cylinder and an outer cylinder, whereas the other has a single cylinder which is inserted between the inner and the outer cylinders.

In a preferred embodiment of the present invention, preferably there is at least partial overlapping between the first cylindrical body 54 and the second cylindrical body 56.

The viscous fluid VF is not limited to silicone oil. For example, the fluid may be provided by traction base oil used in toroidal CVT systems.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an engine including a crank shaft extending in an up-down direction;

a drive shaft extending downward from the crank shaft and including a torsion bar spring;

a propeller shaft;

a propeller provided on the propeller shaft;

a forward/backward switching mechanism arranged to connect the drive shaft and the propeller shaft with each other; and a vibration damper including a first cylindrical body and a second cylindrical body which are penetrated by the torsion bar spring; wherein the first cylindrical body and the second cylindrical body are coaxial with each other and overlap at least partially with each other, either of the first cylindrical body and the second cylindrical body having an upper end portion connected with an upper end portion of the torsion bar spring, the other of the first cylindrical body and the second cylindrical body having a lower end portion connected with a lower end portion of the torsion bar spring;

a viscous fluid fills a space between the first cylindrical body and the second cylindrical body;

at least one of the first cylindrical body and the second cylindrical body includes an inner cylinder and an outer cylinder, and the other of the first cylindrical body and the second cylindrical body is inserted between the inner cylinder and the outer cylinder; and the viscous fluid fills a space between the inner cylinder of the at least one of the first cylindrical body and the second cylindrical body and the other of the first cylindrical body and the second cylindrical body, and a space between the outer cylinder of the at least one of the first cylindrical body and the second cylindrical body and the other of the first cylindrical body and the second cylindrical body.

2. The outboard motor according to claim 1, wherein both of the first cylindrical body and the second cylindrical body extend from the upper end portion to the lower end portion of the torsion bar spring.

3. An outboard motor comprising:

an engine including a crank shaft extending in an up-down direction;

a drive shaft extending downward from the crank shaft and including a torsion bar spring;

a propeller shaft;

a propeller provided on the propeller shaft;

a forward/backward switching mechanism arranged to connect the drive shaft and the propeller shaft with each other; and a vibration damper including a first cylindrical body and a second cylindrical body which are penetrated by the torsion bar spring; wherein the first cylindrical body and the second cylindrical body are coaxial with each other and overlap at least partially with each other, either of the first cylindrical body and the second cylindrical body having an upper end portion connected with an upper end portion of the torsion bar spring, the other of the first cylindrical body and the second cylindrical body having a lower end portion connected with a lower end portion of the torsion bar spring;

a viscous fluid fills a space between the first cylindrical body and the second cylindrical body; and the first cylindrical body has an end portion and the second cylindrical body has an end portion located near the end portion of the first cylindrical body, and the outboard motor further includes a stopper provided in both the end portion of the first cylindrical body and the end portion of the second cylindrical body to limit an axial pivotal movement of one of the first and second cylindrical bodies with respect to the other of the first and second cylindrical bodies within a predetermined angle range.

* * * * *